US007621473B2

(12) United States Patent
Capelle, Jr.

(10) Patent No.: US 7,621,473 B2
(45) Date of Patent: Nov. 24, 2009

(54) RING JET NOZZLE AND PROCESS OF USING THE SAME

(75) Inventor: William Edward Capelle, Jr., Gulfport, MS (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 521 days.

(21) Appl. No.: 11/269,777

(22) Filed: Nov. 8, 2005

(65) Prior Publication Data

US 2007/0102546 A1 May 10, 2007

(51) Int. Cl.
*B02C 19/06* (2006.01)

(52) U.S. Cl. ..... 241/5; 241/39; 241/40

(58) Field of Classification Search ..... 241/39, 241/40, 5

See application file for complete search history.

(56) References Cited

U.S. PATENT DOCUMENTS

| | | | | |
|---|---|---|---|---|
| 3,178,121 | A | 4/1965 | Wallace, Jr. | |
| 4,416,421 | A | 11/1983 | Browning | |
| 4,567,960 | A | 2/1986 | Johnson et al. | |
| 4,860,959 | A | 8/1989 | Handleman | |
| 5,683,039 | A * | 11/1997 | Leute et al. | 241/5 |
| 7,520,451 | B2 | 4/2009 | Capelle | |
| 2004/0016835 | A1 * | 1/2004 | Casalmir et al. | 241/39 |
| 2004/0169098 | A1 | 9/2004 | Olson | |
| 2006/0175441 | A1 * | 8/2006 | Capelle, Jr. | 241/5 |

FOREIGN PATENT DOCUMENTS

| | | |
|---|---|---|
| JP | 2005118725 | 12/2005 |
| WO | WO2006072073 | 7/2006 |

OTHER PUBLICATIONS

European Search Report.
Linear Aerospike Engine'http://www.eng.fsu.edu/~shih/eml4421/students'%20web%20pages/rocket%20propulsion/aerospike.htm.
"Aerospike Aerodynamics" http://www.aerospace.org/design/aerospike/aerodyamics.shtml.

* cited by examiner

*Primary Examiner*—Bena Miller

(57) ABSTRACT

The embodiments of the present invention relate to a ring jet for use in fluid energy mills. In particular, the embodiments relate to a spiked nozzle containing a nozzle plug forming a fluid compression orifice in form of a partial annulus, to accelerate a grinding fluid used in reducing the particle size of particulate matter. Such ring jets are placed in a circular ring configuration about the outer wall of the fluid energy mill.

8 Claims, 4 Drawing Sheets

RING JET NOZZLE AND PROCESS OF USING THE SAME

FIELD OF THE INVENTION

The embodiments of the present invention relate to a ring jet for use in fluid energy mills. In particular, the embodiments relate to a spiked nozzle containing a nozzle plug forming a fluid compression orifice in form of a partial annulus, to accelerate a grinding fluid used in reducing the particle size of particulate matter. Such ring jets are placed in a circular ring configuration about the outer wall of the fluid energy mill.

BACKGROUND OF THE INVENTION

Fluid energy mills are used to reduce the particle size of a variety of materials such as pigments, agricultural chemicals, carbon black, ceramics, minerals and metals, pharmaceuticals, cosmetics, precious metals, propellants, resins, toner and titanium dioxide. The particle size reduction typically occurs as a result of particle-to-particle collisions because generally, a fluid energy mill contains no moving parts.

The fluid energy mill typically comprises a hollow interior that acts as a grinding chamber where the particle collisions occur. Within the grinding chamber, a vortex is formed via the introduction of a compressed gas or grinding fluid through fluid nozzles fluid energy mill positioned in an annular configuration around the periphery of the grinding chamber. The compressed gas (e.g., air, steam, nitrogen, etc.), when introduced into the grinding chamber, forms a high-speed vortex as it travels within the grinding chamber. The gas circles within the grinding chamber at a decreased radii until released from the grinding chamber through a gas outlet. The particles to be ground are deposited within the grinding chamber and swept up into the high-speed vortex, thereby resulting in high speed particle-to-particle collisions as well as collisions with the interior portion of the grinding chamber walls.

Typically, heavier particles have longer residence time within the vortex. Lighter particles (i.e., those sufficiently reduced particles) move with the vortex of gas until the outlet is reached. Typically, fluid energy mills are capable of producing fine (less than 10 microns) and ultra fine (less than 5 microns) particles.

Typical nozzles that have been used include DeLaval nozzles (converging-diverging nozzles) through which the grinding fluid (also known as compression gas) is injected into the grinding chamber. In such nozzles, the grinding occurs at the boundary between the particles and the high-velocity grinding fluid, also referred to as the shear zone. However, such nozzles are disadvantageous because the pattern of the gas exiting the nozzle results in a substantial core of the gas-stream flow that is unavailable for grinding as the particles cannot penetrate the core of the fluid flow. Therefore, a greater amount of energy is necessary and a greater volume of compression gas is required to grind the particulate matter to the desired particle size.

Another disadvantage, with respect to fluid energy mills typically found within the art, is that they consume a significant amount of resources including energy and grinding gas due to the particular nozzles used therein.

Thus, there is a need within the industry for a mechanism for reducing energy and compression gas consumption as well as increasing the surface area of the fluid boundary useable for grinding particulate matter.

The present invention proposes placing ring jets in an annular configuration around the fluid energy mill. These ring jets have a spiked nozzle with a 'C' shaped compression orifice and opening. The spiked nozzle is shaped such that its surface is flush with the inside wall of the fluid energy mill. Grinding fluid emanating from the ring jets attrites the larger particles that are found closer to the wall of the fluid energy mill. Once the larger particles are ground to finer particles of desired size, such smaller particles leave the chamber through an outlet.

SUMMARY OF THE INVENTION

This invention relates to a ring jet, comprising:

(a) a cylindrical member having an inner face and an outer face, and a first end and a second end, thereby defining a hollow interior wherein said cylindrical member has a cowl lip configuration at said second end; and (b) a fluid acceleration region at said second end of said cylindrical member, comprising:

(i) a nozzle plug at said second end of said cylindrical member, comprising a means for securing said nozzle plug to said cylindrical member, a partially-cylindrical portion connected to said means for securing said nozzle plug to said cylindrical member, said partially-cylindrical portion having an upstream end proximate to said means for securing said nozzle plug and a downstream end closer to said second end, and a ramped portion connected with said downstream end of said partially-cylindrical portion, said ramped portion having a proximal end and a distal end; and (ii) a fluid compression orifice defined by said ramped portion of said nozzle plug and said cowl lip of said cylindrical member, wherein said compression orifice is in a 'C' shape when viewed into said ring jet at said second end.

This invention also relates to a nozzle plug, comprising:

(i) a means for securing said nozzle plug to the cylindrical member, a partially-cylindrical portion connected with said means for securing the nozzle plug to said cylindrical member, said partially-cylindrical portion having an upstream end and a downstream end, and a ramped portion having a proximal end and a distal end, where said proximal end is connected with the downstream end of said third cylindrical form, and (ii) a partially-annular, or a 'C' shaped fluid compression orifice defined by said ramped portion of said nozzle plug and said cowl lip.

This invention further relates to a fluid energy mill comprising at least one ring jet at an angle, in a ring configuration, along the outer wall of said fluid energy mill, wherein said ring jet comprises:

(a) a cylindrical member having an inner face and an outer face, and a first end and a second end, thereby defining a hollow interior wherein said cylindrical member has a cowl lip configuration at said second end; and (b) a fluid acceleration region at said second end of said cylindrical member, comprising:

(i) a nozzle plug at said second end of said cylindrical member, comprising a means for securing said nozzle plug to said cylindrical member, a partially-cylindrical portion connected to said means for securing said nozzle plug to said cylindrical member, said partially-cylindrical portion having an upstream end proximate to said means for securing said nozzle plug and a downstream end closer to said second end, and a ramped portion connected with said downstream end of said partially-cylindrical portion, said ramped portion having a proximal end and a distal end; and (ii) a fluid compression orifice defined by said ramped portion of said nozzle plug and said cowl lip of said cylindrical member, wherein said compression orifice is in a 'C' shape when viewed into said ring jet at said second end;

wherein said nozzle plug is truncated to be flush with the outer wall of said fluid energy mill.

This invention also relates to a method of reducing the size of particulate matter comprising:

(a) supplying a first grinding fluid to a feed jet;

(b) delivering a particulate matter feed stream comprising a particulate matter, to said feed jet having said first grinding fluid exiting therefrom;

(c) leading said particulate matter and said first grinding fluid through a feed tube into a fluid energy mill, said fluid energy mill comprising at least one ring jet at an angle, in a ring configuration, along the outer wall of said fluid energy mill, wherein said ring jet comprises:

(i) a cylindrical member having an inner face and an outer face, and a first end and a second end, thereby defining a hollow interior wherein said cylindrical member has a cowl lip configuration at said second end; and (ii) a fluid acceleration region at said second end of said cylindrical member, comprising:

(A) a nozzle plug at said second end of said cylindrical member, comprising a means for securing said nozzle plug to said cylindrical member, a partially-cylindrical portion connected to said means for securing said nozzle plug to said cylindrical member, said partially-cylindrical portion having an upstream end proximate to said means for securing said nozzle plug and a downstream end closer to said second end, and a ramped portion connected with said downstream end of said partially-cylindrical portion, said ramped portion having a proximal end and a distal end; and (B) a fluid compression orifice defined by said ramped portion of said nozzle plug and said cowl lip of said cylindrical member, wherein said compression orifice is in a 'C' shape when viewed into said ring jet at said second end;

wherein said nozzle plug is truncated such that it is flush with the outer wall of said fluid energy mill;

(d) providing said ring jets with a second grinding fluid; and (e) dispersing said particulate matter at an intersection of said grinding fluid and said particulate matter feed stream within the fluid energy mill.

BRIEF DESCRIPTION OF THE DRAWINGS

Many aspects of the embodiments of the present invention can be more fully understood with reference to the following drawings. The components set forth in the drawings are not necessarily to scale. Moreover, in the drawings, the reference numerals designate corresponding parts throughout the several views.

DETAILED DESCRIPTION

Figure 1:
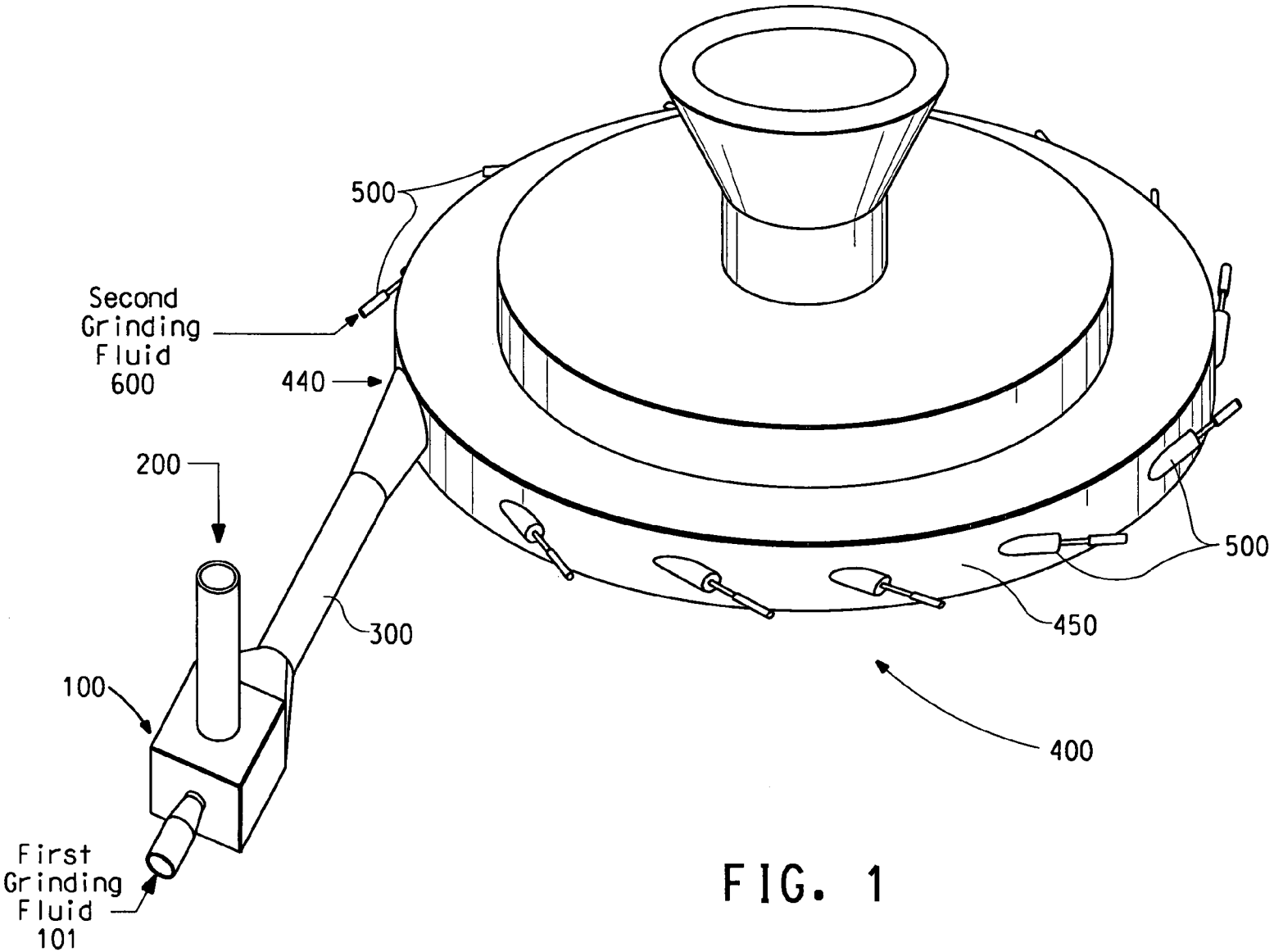
FIG. 1 shows a general schematic of fluid energy mill being fed with grinding fluid and particulate matter to be ground.

By "grinding" of particulate matter is meant a possible "size reduction" of particulate matter. The term "grinding" and the term "size reduction" may be used interchangeably in this application. Both the terms are equivalent in their meaning.

The term "ring jet" and the term "spiked nozzle" may be used interchangeably in this application. Both the terms are equivalent in their meaning.

The present invention relates to spiked nozzles and their use in grinding of particulates in a fluid energy mill. In the present invention, generally, particulate matter, for example pigment particulates, is entrained with a grinding fluid and injected into the chamber of a fluid energy mill by a large feed jet and a feed tube. The particulates and the grinding fluid then enter a circular ring situated around the main body of the fluid energy mill. This ring is surrounded by small supersonic jets with the spiked nozzles, referred to as ring jets.

This invention relates to such ring jets. Generally, large particles of the particulate matter in the grinding stream, moving in circular direction along the circular wall of the fluid energy mill, are classified out of the main flow of the grinding stream and end up closer, and against the inner surface of the outer wall of the fluid energy mill, where these particles are eventually caught by a ring jet. The small, but high-velocity gas streams (grinding fluid) emanating from the ring jets entrain the large particles and cause their attrition (among other things) through high-speed shear, particle-to-particle collisions, and/or particle-to-wall collisions. Eventually, the attrited particles join the main grinding stream flow out of the body of the fluid energy mill.

Embodiments of the present invention relate to such spiked nozzles. Such spiked nozzles comprise a nozzle plug to form a fluid acceleration region that can increase the velocity of a grinding fluid to allow for particle-size reduction.

Specifically, the nozzle plug is shaped such that it allows for the exit point of the ring jet to be placed more closely to the inner surface of the outer wall of the fluid energy mill. Therefore circulating particulate matter can encounter the ring jet closer to the nozzle exit where the shear force from the grinding stream is the highest. This is accomplished by truncating the conical nozzle plug and shaping it such that it plugs a portion of the compression orifice of the ring jet, to form a C-shaped, partially-annular, compression orifice (for comparison purposes, if the nozzle plug were symmetrical, the compression orifice would be an 'O' shaped annular orifice). Further, the nozzle plug is truncated at an angle that will allow the ring jet exit point to be essentially flush with the inner surface of the outer wall.

Further, the truncated nozzle plug is cut in such a way as to create the C-shaped cone of high-energy grinding fluid (steam, for example) with over twice the surface area of a standard DeLaval nozzle. Consequently, not only is the nozzle sized for a smaller gas flow but is also made more efficient at converting the shear force to grinding energy due to the extended surface area and the 'C' shape.

The ring jet embodiments provide a fluid velocity (or fluid acceleration) that is greater than that found with other types of nozzles (e.g., DeLaval nozzles). Thus, the embodiments of the present invention result in a high velocity fluid flow (e.g., supersonic velocities) having a reduced core portion of the fluid flow, thereby subjecting the particulate matter to a shear zone. Preferably, the spiked nozzle is capable of providing an increased fluid velocity, a greater fluid surface area having the higher velocity, and a reduction in the energy consumption of a fluid energy mill.

The embodiments of the present invention may be utilized in the particle-size reduction of a wide variety of particulate matter. Non-limiting examples of suitable types of particulate matter include pigments, agricultural chemicals, carbon black, ceramics, minerals and metals, pharmaceuticals, cosmetics, precious metals, propellants, resins, toner and titanium dioxide. Grinding combinations of a variety of particulate matter may also be performed. Typically, the particulate matter is entrained in a grinding fluid feed stream, which may be compressed air or other gas or a combination of gases.

With reference to FIG. 1, the operation of a fluid energy mill includes the use of a first grinding fluid (101) and a second grinding fluid (600). The first grinding fluid (101) or the second grinding fluid (600) may comprise a single fluid or a combination of fluids thereby forming a composite fluid stream. The combinations of fluids and the proportions of each fluid therein may be varied to meet the necessary parameters for the particular grinding application.

Non-limiting examples of grinding fluids include air, nitrogen, steam and combinations thereof, wherein steam is preferred. Composite fluid streams may comprise steam and a second gas or other combination of gases.

Typically, depending upon the grinding fluid to be used, the first or the second grinding fluid is delivered at a particular temperature and pressure. Such parameters are known to those skilled in the art. For example, steam is often heated to a temperature ranging from about 220° C. to about 340° C., preferably ranging from about 260° C. to about 305° C. prior to delivery into the spiked nozzle. Preferably, it is supplied at a pressure of about 375 psi (2.580 MPa) to about 500 psi (3.450 MPa), more preferably ranging from about 390 psi (2.688 MPa) to about 440 psi (3.032 MPa). From calculations, it can be shown that an embodiment of a spiked nozzle operated at the above-described parameters would result in the grinding fluid having a velocity (when measured at the point of discharge from the spiked nozzle) of up to about Mach 6.8 (A speed of Mach 1 corresponds to the speed of sound, which is about 340 m/s. A speed of Mach 6.8 is 6.8 times the speed of sound, i.e., about 2312 m/s).

As shown in FIG. 1, particulate matter (200) is supplied to the fluid energy mill (400) through a feed jet (100), wherein the first grinding fluid (101) entrains the particulate matter (200) fed to the feed jet (100). The particulate matter (200) is then carried through a feed tube (300) into a fluid energy mill (400) through an inlet (440) to the fluid energy mill (400). The fluid energy mill (400) has spiked-nozzle shaped ring jets (500) situated in a circular orientation, or a ring (450), about the fluid energy mill.

In one embodiment, the fluid energy mill (400) has at least one ring jet (500). In another embodiment, the fluid energy mill (400) can have as many as 50 ring jets (500) placed about the fluid energy mill (400) in the circular orientation. In one embodiment, a ring jet may be placed equidistant from its two neighboring ring jets. In another embodiment, a ring jet may not be placed equidistant from its two neighboring ring jets. In another embodiment, some ring jets may be placed equidistant from their neighbors and other ring jets may not be placed equidistant from their neighbors. In other embodiments, the range of the number of ring jets is selected from the group consisting of 1 to 5, 1 to 10, 1 to 15, 1 to 20, 1 to 25, 1 to 30, 1 to 35, 1 to 40, 1 to 45, 1 to 50, 1 to 3, 4 to 6, 7 to 9, 10 to 12, 13 to 15, 16 to 18, 19 to 21, 22 to 24, 25 to 27, 28 to 30, 31 to 33, 34 to 36, 37 to 39, 40 to 42, 43 to 45, 46 to 48, and 49 to 50.

Figure 2A:
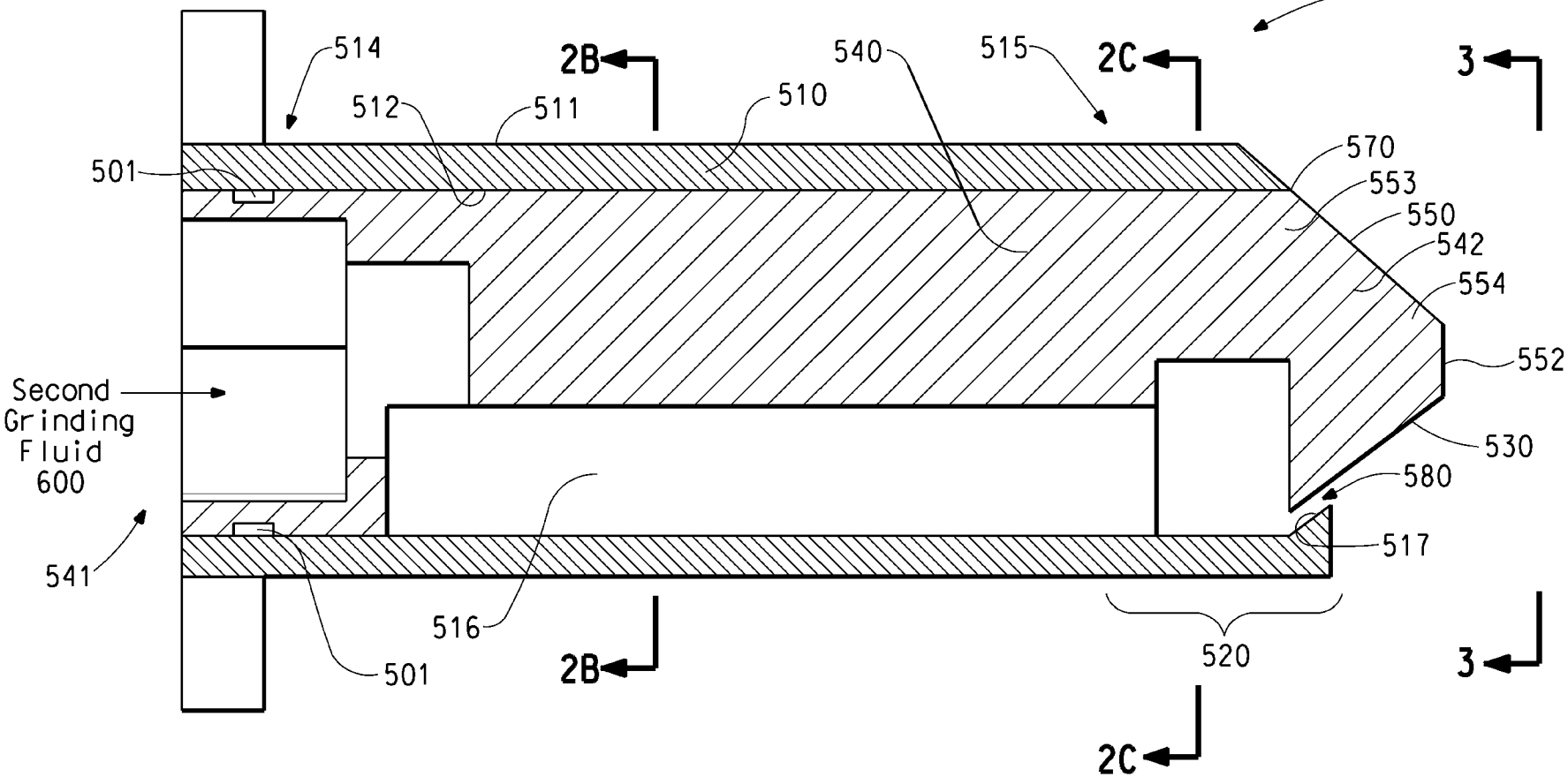
FIG. 2A shows the cross-sectional side view of an embodiment of a spiked nozzle or a ring jet.

In FIG. 2A, the cross-sectional side view of the ring jet is shown. As shown in the FIG., embodiments of the present invention contemplate a ring jet in the configuration of a spiked nozzle (500), comprising:

(a) a cylindrical member (510) comprising an outer face (511), and an inner face (512) and a first end (514) and a second end (515), thereby defining a hollow interior (516); wherein the cylindrical member (510) has a cowl lip configuration (517) at its second end (515), wherein the cowl lip (517) forms a 'C' shape when viewed into the ring jet (500) at the second end (515) (See FIG. 3 also); and (b) a fluid acceleration region (520) of the second end (515) of the cylindrical member (510), comprising:

(i) a nozzle plug (530) (which is inserted into the second end (515) of the cylindrical member (510)), comprising a means for securing the nozzle plug (530) to the cylindrical member (510), a partially-cylindrical portion (540) connected to the means for securing the nozzle plug (530) to the cylindrical member (510), the partially-cylindrical portion (540) having an upstream end (541) proximate to the means for securing the nozzle plug (530) and a downstream end (542) closer to the second end (515) than the upstream end (541); the downstream end (542) comprising a ramped portion (550) wherein said ramped portion has a proximal end (553) and a distal end (554), and (ii) a fluid compression orifice (580) defined by the ramped portion (550) of the nozzle plug (530) and the C-shaped cowl lip (517) at the upstream end (515) of the cylindrical member (510).

The components (e.g., the cylindrical member, nozzle plug, etc.) of the present invention may be constructed of any material capable of withstanding the temperatures, forces, and pressures generated and encountered during normal operation of a fluid energy mill (400). Typically the cylindrical member (510) may be machined or constructed of materials such as, for example, solid bar stock or heavy walled pipe (e.g., Schedule 40, 80 or 160 pipe, which are known to those skilled in the art). The nozzle plug (530) is typically constructed of any metallic material or cast from ceramic materials. Preferably, the nozzle plug (530) is constructed of a rust resistant material such as, for example, stainless steel.

The cylindrical member (510) acts as a conduit to introduce the grinding fluid (600) into the grinding chamber of the fluid energy mill (400) such that the grinding fluid (600) flows past the nozzle plug (530). The cylindrical member (510) may be of any size known in the art to be suitable for use with fluid energy mills. Typically, as the diameter of the cylindrical member (510) increases, the surface area of the grinding fluid jet (area available for grinding) also increases, thus resulting in a better shear zone (a greater grinding surface area).

The cylindrical member (510) comprises an outer face (511) and an inner face (512) as well as a first end (514) and a second end (515) thereby defining a hollow interior (516) through which the second grinding fluid (600) travels. The first end (514) is upstream of the second end (515) such that the second grinding fluid (600) flow is generally away from the first end (514) and towards the second end (515).

The second end (515) of the cylindrical member (510) contains the fluid acceleration region (520) of the spiked nozzle or the ring jet (500), wherein the second grinding fluid (600) is subjected to a fluid compression orifice (580), thereby accelerating it to a high velocity as it exits from the spiked nozzle or the ring jet (500). The fluid compression orifice (580) is formed by the insertion of the nozzle plug (530) into the second end (515) of the cylindrical member (510) and in conjunction with the cowl lip (517) of the cylindrical member (510). The fluid compression orifice is shaped in a 'C' when viewed from the second end (515) into the ring jet (See FIG. 3).

Figure 2B:
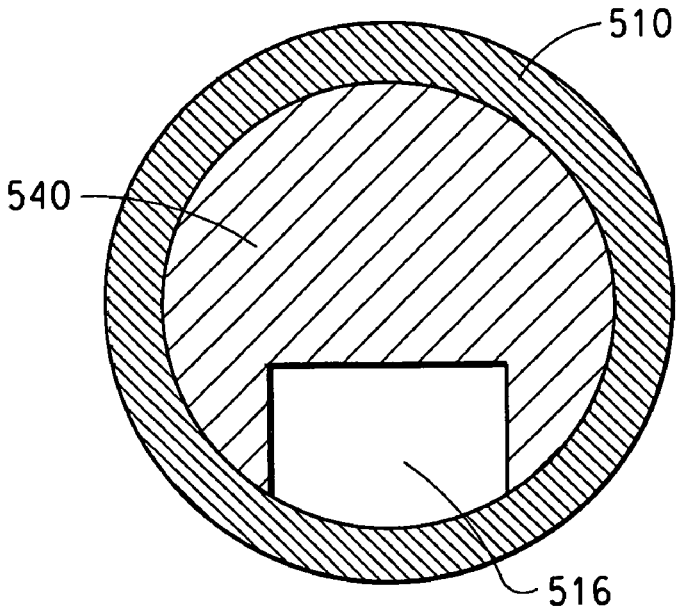
FIG. 2B shows the cross-sectional view of the spiked nozzle at section B-B in FIG. 2A.
Figure 2C:
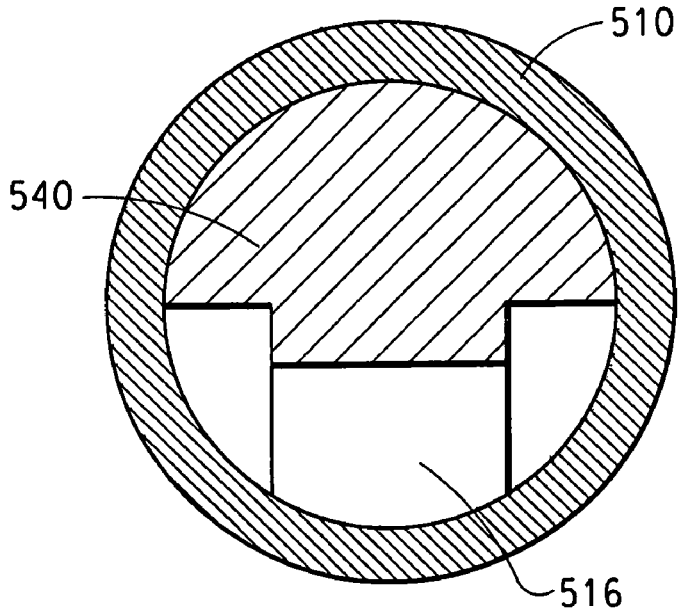
FIG. 2C shows a cross-sectional view of the spiked nozzle at section C-C in FIG. 1.

FIG. 2B shows the cross section of the spiked nozzle closer to the upstream end (541) of the nozzle (see also FIG. 2A). This view represents the channel (516) created in between the cylindrical member (510) and the partially cylindrical portion (540) through which the second grinding fluid (600) travels before encountering the fluid acceleration region (520). The spiked nozzle or the ring jet (500) is shaped such that it allows the exit of the ring jet to be placed more closely to the inner surface of the outer wall of the fluid energy mill (400). Therefore, circulating particulate matter (200), now entrained in the fluid energy mill (400), can encounter the ring jets closer to the nozzle exit that is the truncated spike (552) where the shear force from the second grinding fluid (600) is the highest. This is accomplished by truncating the ramped portion of the conical nozzle plug (550) and plugging one end of its rim (570), and cutting it off at an angle that will allow the conical nozzle plug (530) to be essentially flush with the inner surface of the outer wall of the fluid energy mill (400).

Figure 3:
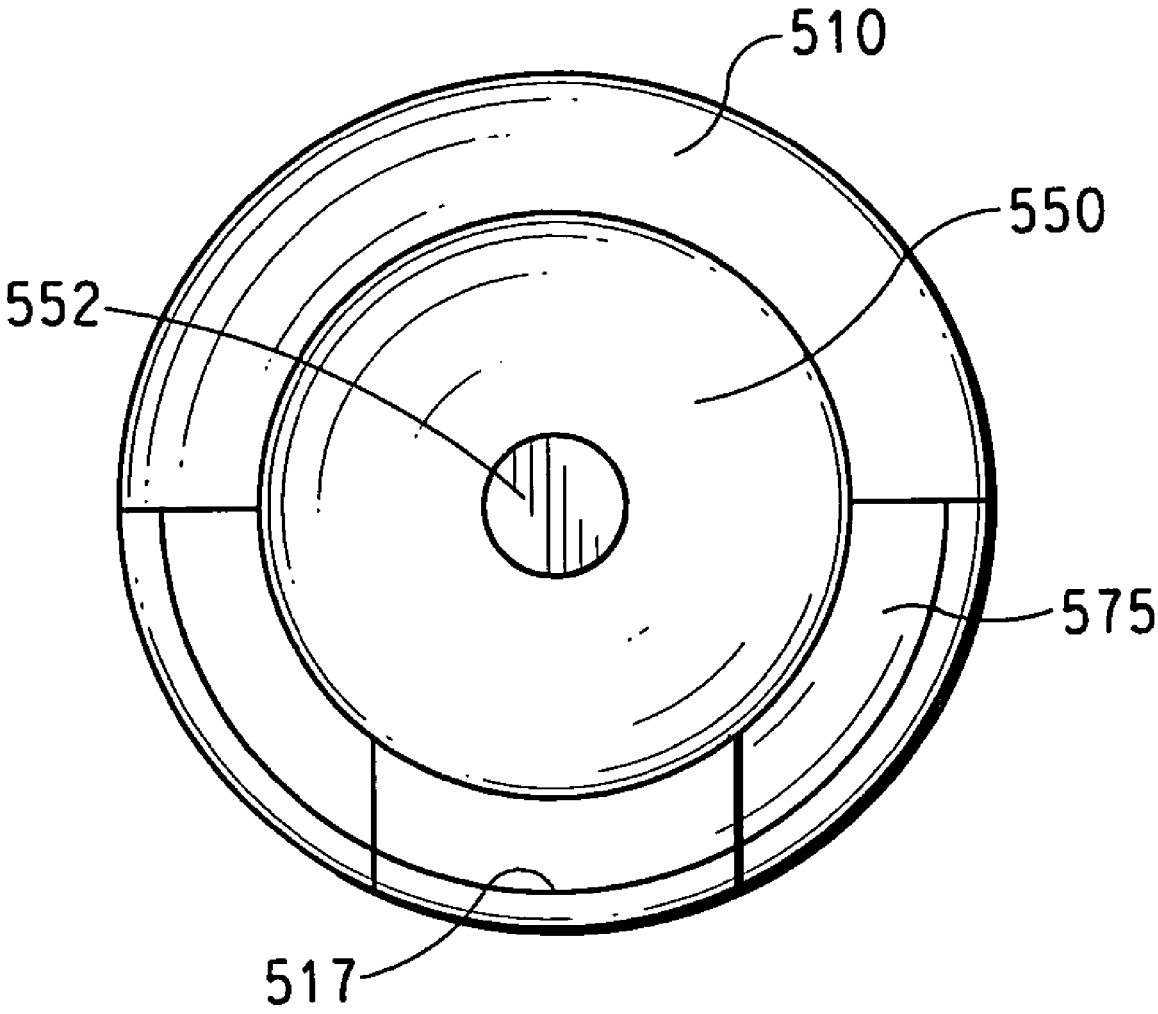
FIG. 3 shows the end view of the spiked nozzle.

As shown in FIG. 3, the truncated ramped portion (550) of the conical nozzle plug (530) is cut in such a way as to create a 'C' shaped cone (575) of high-energy second grinding fluid (steam) (600) with over twice the surface area of a standard DeLaval nozzle. Consequently, not only is the nozzle sized for a smaller gas flow, for example steam, but also made more efficient at converting the shear to grinding energy due to the extended surface area and the 'C' shape.

The nozzle plug (530) comprises a means for securing (501) the nozzle plug to the cylindrical member (510), a partially-cylindrical portion (540) and a ramped portion (550) ending in the nozzle exit that is the truncated spike (552). Examples of various means for securing the nozzle plug to the cylindrical member include, but are not limited to, fins, bars or arms (welded or otherwise connected to or formed in the partially-cylindrical portion (540)) wherein such fins, arms or bars extend from the partially-cylindrical portion (540) to the inner face (512) of the cylindrical member (510). The methods utilized to secure the nozzle plug within the cylindrical member should provide for the necessary stability and support such that the nozzle plug (530) remains properly centered and plugged so that during the normal operation of a fluid energy mill (400), the fluid compression orifice (580) remains consistent in its 'C' shape over its area in terms of grinding fluid flow.

The second grinding fluid (600) exits the ring jet (500) at an angle in the range of from about 10° to the tangent at the inner surface of the outer wall of the fluid energy mill (400) to about 50° to the tangent at the inner surface of the wall of the fluid energy mill (400). This angle can be changed as desired by changing the ring jets (500) and the truncation of the ramped portion (550) of the nozzle plug (530) such that the truncated spike at the ring jet exit (552) of the nozzle plug (530) is flush with the inner surface of the wall of the fluid energy mill (400), creating a 'C' shape for the compression orifice (580) from which the second grinding fluid is thrust out into the fluid energy mill (400) chamber at supersonic speed, if desired.

Preferably, there is no drop in pressure along the length of the cylindrical member (510) from the point of second grinding fluid (600) introduction to the fluid compression orifice (580). However, a pressure drop may result as a consequence of the means for securing the nozzle plug to the cylindrical member, although the pressure drop is preferably not greater than 5%.

The partially-cylindrical portion (540) is connected with the cylindrical member (510) at its upstream end (541). The partially-cylindrical portion (540) and ramped portion (550) may be originally formed as a unitary structure, or alternatively, may be individual pieces that are welded together to form a single piece. The partially-cylindrical portion (540) is not limited to any particular diameter or length so long as the requisite level of stability and structural integrity is conferred to the entirety of the nozzle plug (530), and the compression orifice (580) assumes a 'C' shape in conjunction with the cowl lip (517).

In one embodiment, the ramped portion (550) of the nozzle plug (530) is machined off flat to match the inside flow line of the liner of the fluid energy mill. However, the surface of the nozzle plug (530) is hyperbolic comprising a proximal end (553) and a distal end (554), wherein the ramped portion decreases in diameter in the downstream direction until it ends in a truncated spike (552). The ramped portion (550) in conjunction with the cowl lip (517) forms a 'C' shaped compression orifice (580) and the exit for the grinding fluid (600). In such embodiment, typically, the curve of the ramped portion (550) is such that the initial entrance is on a tangent about 45 degrees (the angle at which the second grinding fluid (600) exits the fluid compression orifice (580) from the central nozzle axis and then tapers to various lengths, although the tangent angle may vary such that for example it may measure 35 degrees.

With respect to the truncated spike 552, it creates turbulence in the fluid flow, thereby generating a lift to the flow and directing it towards the outside of the nozzle flow. Preferably the length of the ramped portion can be 2.5 times the diameter of the ramped portion as measured at its widest point. In another embodiment, the ramp is machined off to match the inside curvature of the liner, which is a function of the projection of the entire nozzle.

The fluid compression orifice (580), a C-shaped, partially-annular orifice, serves to accelerate the second grinding fluid (600) as a constant volume of second grinding fluid (600) entering the ring jet must exit through the restrictive fluid compression orifice (580). Typically, the partially-annular area of the fluid compression orifice (580) is up to about 60% of the area of a throat cross section of a similar DeLaval nozzle. The fluid compression orifice (580) is formed by the proximal end (553) of the hyperbolic section of the nozzle plug (530) and a cowl lip (517) formed at the second end (515) of the cylindrical member (510) (See FIG. 2A).

Also, the nozzle plug (530) is shaped in such a way that it plugs a portion of the compression orifice (580) to provide a 'C' shaped compression orifice. If the ramped portion (550) of the nozzle plug (530) were axisymmetric, such a plug would have formed an annular-shaped compression orifice. Further, the spike of the nozzle plug (552) is truncated at an angle such that when the entire ring jet assembly (500) is attached to the inner surface of the outer wall of the fluid energy mill (400) at a desired angle to a direction tangential to the inside wall of the fluid energy mill (400) and the truncated spike (552) of the ramped portion (550) of the nozzle plug (530) is flush with the inner surface of the outer wall of the fluid energy mill (400). When viewed from the inside of the fluid energy mill chamber, a ring jet exit appears as a 'C' shape in a ring configuration.

The fluid compression orifice (580) should be sized with the equivalent ratio of a DeLaval jet. Preferably, the fluid compression orifice width is about 10 times longer than the gap. For example, a typical DeLaval nozzle (having a throat diameter of 2 inches) has a fluid compression orifice area of about 1 sq. in. However, an embodiment of the present invention having the same equivalent grinding (rate/product) as the DeLaval nozzle generally has a fluid compression orifice total area that is about 60% of the measured area found in the DeLaval nozzle and flows about 40% less compression fluid. The area of the fluid compression orifice may vary according to the desired flow rate of the grinding fluid and the type of product undergoing particle size reduction.

The embodiments of the present invention may further be coated with an abrasion resistant coating such as aluminum oxide, or chrome oxide to prevent clogging or agglomeration at the spiked nozzle tip (552) when sticky particulate matter is being ground.

Typically, the ring jet (500) is operated by the introduction of second grinding fluid (600) into the first end (514) of the cylindrical member (510) at velocities that vary greatly depending upon the type of second grinding fluid (600), the pressure at which it is used during normal operation, and the amount of grinding energy required to reach a particular particle size. The second grinding fluid (600) travels along the major nozzle axis until it encounters the fluid compression orifice (580). As the second grinding fluid (600) passes through the fluid compression orifice (580) it undergoes severe acceleration, increasing its velocity from substantially its initial introduction velocity to supersonic velocities. As the second grinding fluid (600) moves through the ring jet (500), its velocity increases until its maximum velocity is reached as the compressed fluid exits the spiked nozzle (500). The second grinding fluid (600) undergoes expansion as it exits the fluid compression region (580) as a result of the truncated spike (552). The second grinding fluid (600) expands in a 'C' shape and in an inward direction towards the major nozzle axis. The turbulent flow assists in causing the particle-to-particle collisions.

The embodiments of the present invention further contemplate a method of reducing the size of particulate matter comprising:

(1) supplying a first grinding fluid (101) to a feed jet (100),
(2) delivering a particulate matter feed stream (200) containing a particulate matter to the feed jet 100 having the first grinding fluid (101) exiting therefrom;
(3) leading the particulate matter (200) and the first grinding fluid (101) through a feed tube (300) into a fluid energy mill (400);
(4) providing ring jets (500) at an angle, in a ring configuration, along the outer wall of the fluid energy mill (400) such that the compression orifice (580) of said ring jet is in a 'C' shape, wherein the truncated portion (550) of the nozzle plug (530) is flush with the outer wall of the fluid energy mill (400);
(5) providing a second grinding fluid (600) through the ring jet; and
(6) dispersing the particulate matter at an intersection of the second grinding fluid (600) and the particulate matter feed stream.

In this configuration, larger particles are classified toward the outer wall of the fluid energy mill (400) such that they come in contact with the second grinding fluid (600) emanating at supersonic velocity from a ring jet (500) at very high shear. As a result of the high shear force of the grinding fluid (600), and as a result of the particle-to-particle collision the larger particles are gradually attrited to a smaller desired size. The smaller particles then subsequently are mixed into the mainstream of the particulates exiting the fluid energy mill chamber. Typically, the particulate matter is entrained at the point of highest velocity, which is at the discharge area of the fluid compression orifice (580) (i.e., the tip of the spiked nozzle (552) (also known as the plane at the exit of the nozzle). The reduction in particle size generally occurs in the shear zone, which exists at the intersection or boundary between the particulate matter feed stream and the high velocity fluid exiting the ring jet (500).

For the embodiments of the present invention the increased size of the shear zone surface area translates into the need to utilize a smaller volume of the second grinding fluid (600) to achieve the same result seen with standard jets. Thus, the embodiments of the present invention allow a fluid energy mill to perform more efficiently such that less energy is consumed in the production of the same volume of fine or ultrafine particles as those nozzles currently used. The overall effect of the embodiments of the present invention is an increase in grinding efficiency.

What is claimed is:

1. A ring jet, comprising:

(a) a cylindrical member having an inner face and an outer face, and a first end and a second end, thereby defining a hollow interior wherein said cylindrical member has a cowl lip configuration at said second end; and (b) a fluid acceleration region at said second end of said cylindrical member, comprising:

(i) a nozzle plug at said second end of said cylindrical member, comprising a means for securing said nozzle plug to said cylindrical member, a partially-cylindrical portion connected to said means for securing said nozzle plug to said cylindrical member, said partially-cylindrical portion having an upstream end proximate to said means for securing said nozzle plug and a downstream end closer to said second end, and a ramped portion connected with said downstream end of said partially-cylindrical portion, said ramped portion having a proximal end and a distal end; and (ii) a fluid compression orifice defined by said ramped portion of said nozzle plug and said cowl lip of said cylindrical member, wherein said compression orifice is in a 'C' shape when viewed into said ring jet at said second end.

2. The ring jet as recited in claim 1, wherein said fluid compression orifice is a partially-annular orifice.

3. A fluid energy mill comprising at least one ring jet at an angle, in a ring configuration, along the outer wall of said fluid energy mill, wherein said ring jet comprises:

(a) a cylindrical member having an inner face and an outer face, and a first end and a second end, thereby defining a hollow interior wherein said cylindrical member has a cowl lip configuration at said second end; and (b) a fluid acceleration region at said second end of said cylindrical member, comprising:

(i) a nozzle plug at said second end of said cylindrical member, comprising a means for securing said nozzle plug to said cylindrical member, a partially-cylindrical portion connected to said means for securing said nozzle plug to said cylindrical member, said partially-cylindrical portion having an upstream end proximate to said means for securing said nozzle plug and a downstream end closer to said second end, and a ramped portion connected with said downstream end of said partially-cylindrical portion, said ramped portion having a proximal end and a distal end; and (ii) a fluid compression orifice defined by said ramped portion of said nozzle plug and said cowl lip of said cylindrical member, wherein said compression orifice is in a 'C' shape when viewed into said ring jet at said second end;

wherein said nozzle plug is truncated to be flush with the outer wall of said fluid energy mill.

4. The fluid energy mill as recited in claim 3, wherein range of the number of said at least one ring jet is selected from the group consisting of 1 to 5, 1 to 10, 1 to 15, 1 to 20, 1 to 25, 1 to 30, 1 to 35, 1 to 40, 1 to 45, 1 to 50, 1 to 3, 4 to 6, 7 to 9, 10 to 12, 13 to 15, 16 to 18, 19 to 21, 22 to 24, 25 to 27, 28 to 30, 31 to 33, 34 to 36, 37 to 39, 40 to 42, 43 to 45, 46 to 48, and 49 to 50.

5. The fluid energy mill as recited in claim 4, wherein (i) if the number of said ring jets is more than one then each said ring jet is placed equidistant from its two neighboring ring jets or each said ring jet is placed not equidistant from its two neighboring ring jets, and (ii) if the number of ring jets is more than three then some said ring jets are placed equidistant from its two neighboring ring jets and some said ring jets are placed not equidistant from its two neighboring ring jets.

6. A method of reducing the size of particulate matter comprising:

(a) supplying a first grinding fluid to a feed jet;

(b) delivering a particulate matter feed stream comprising a particulate matter, to said feed jet having said first grinding fluid exiting therefrom;

(c) leading said particulate matter and said first grinding fluid through a feed tube into a fluid energy mill, said fluid energy mill comprising at least one ring jet at an angle, in a ring configuration, along the outer wall of said fluid energy mill, wherein said ring jet comprises:

(i) a cylindrical member having an inner face and an outer face, and a first end and a second end, thereby defining a hollow interior wherein said cylindrical member has a cowl lip configuration at said second end; and (ii) a fluid acceleration region at said second end of said cylindrical member, comprising:

(A) a nozzle plug at said second end of said cylindrical member, comprising a means for securing said nozzle plug to said cylindrical member, a partially-cylindrical portion connected to said means for securing said nozzle plug to said cylindrical member, said partially-cylindrical portion having an upstream end proximate to said means for securing said nozzle plug and a downstream end closer to said second end, and a ramped portion connected with said downstream end of said partially-cylindrical portion, said ramped portion having a proximal end and a distal end; and (B) a fluid compression orifice defined by said ramped portion of said nozzle plug and said cowl lip of said cylindrical member, wherein said compression orifice is in a 'C' shape when viewed into said ring jet at said second end;

wherein said nozzle plug is truncated such that it is flush with the outer wall of said fluid energy mill;

(d) providing said ring jets with a second grinding fluid; and (e) dispersing said particulate matter at an intersection of said grinding fluid and said particulate matter feed stream within the fluid energy mill.

7. The method as recited in claim 6, wherein said particulate matter comprises at least one of pigments, agricultural chemicals, carbon black, ceramics, minerals, metals, pharmaceuticals, cosmetics, precious metals, propellants, resins, toner and titanium dioxide.

8. The method as recited in claim 6, wherein said grinding fluid comprises at least one of air, nitrogen and steam.

* * * * *

UNITED STATES PATENT AND TRADEMARK OFFICE

CERTIFICATE OF CORRECTION

PATENT NO. : 7,621,473 B2
APPLICATION NO. : 11/269777
DATED : November 24, 2009
INVENTOR(S) : William Edward Capelle, Jr.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 902 days.

Signed and Sealed this

Twenty-sixth Day of October, 2010

David J. Kappos

David J. Kappos
*Director of the United States Patent and Trademark Office*